United States Patent [19]

Inouye et al.

[11] 4,083,721

[45] Apr. 11, 1978

[54] PHOTOGRAPHIC PHENOLIC COUPLERS WITH AMIDO COUPLING-OFF GROUPS

[75] Inventors: Kozo Inouye; Yukio Yokota; Akio Okumura; Keisuke Shiba; Seiiti Kubodera, all of Minami-ashigara, Japan

[73] Assignee: Fuji Photo Film Co., Ltd., Minami-ashigara, Japan

[21] Appl. No.: 748,604

[22] Filed: Dec. 8, 1976

Related U.S. Application Data

[63] Continuation-in-part of Ser. No. 604,864, Aug. 14, 1975, abandoned.

[30] Foreign Application Priority Data

Aug. 14, 1974 Japan ..... 49-92895

[51] Int. Cl.[2] ..... G03C 1/40; G03C 7/00

[52] U.S. Cl. ..... 96/56.2; 96/55; 96/56.6; 96/77; 96/100 R

[58] Field of Search ..... 96/95, 56.6, 55, 100, 96/56.2, 77; 260/561 HL, 562 B

[56] References Cited

U.S. PATENT DOCUMENTS

| | | | |
|---|---|---|---|
| 3,291,609 | 12/1966 | Porter et al. | 96/76 R |
| 3,676,494 | 7/1972 | Biland et al. | 260/562 B |
| 3,808,945 | 5/1974 | Matsuo et al. | 96/100 |
| 3,836,564 | 9/1974 | Baker et al. | 260/562 B |
| 3,892,786 | 7/1975 | Baker et al. | 260/561 HL |
| 3,898,273 | 8/1975 | Baker et al. | 260/562 B |

FOREIGN PATENT DOCUMENTS 503,826 4/1939 United Kingdom.

*Primary Examiner*—Edward C. Kimlin
*Assistant Examiner*—Richard L. Schilling
*Attorney, Agent, or Firm*—Sughrue, Rothwell, Mion, Zinn and Macpeak

[57] ABSTRACT

A photographic coupler represented by the following formula (I)

[A] — NHCOR (I)

wherein A represents a cyan color forming coupler residue having a naphthol nucleus or a phenol nucleus; the RCONH-group is a substituted in the coupling position of [A], and R represents (1) an aliphatic hydrocarbon or alicyclic hydrocarbon group which has at least one electron attractive substituent in the $\alpha$-position to the carbonyl group in the RCONH- group, or (2) an aryl group, a heterocyclic group, an alkoxycarbonyl group, an aryloxycarbonyl group, a carbamoyl group, an acyl group or an amino group which may be substituted with one or more electron attractive substituents, and R as defined by (1) or (2) above is a residue of a carboxylic acid of the formula RCOOH having a pKa of about 1.3 or less; a photographic light-sensitive silver halide emulsion containing the photographic coupler; and a method of forming images comprising developing an exposed photographic light-sensitive silver halide emulsion in the presence of the photographic couplers.

14 Claims, No Drawings

PHOTOGRAPHIC PHENOLIC COUPLERS WITH AMIDO COUPLING-OFF GROUPS

CROSS REFERENCE TO THE RELATED APPLICATION

This is a continuation-in-part application of Ser. No. 604,864, filed Aug. 14, 1975, now abandoned.

BACKGROUND OF THE INVENTION

1. Field of the Invention

The present invention relates to photographic color couplers. In greater detail, it relates to novel photographic 2-equivalent cyan color forming couplers.

2. Description of the Prior Art

It is well known that oxidized aromatic primary amine developing agents react with dye forming couplers to form color images by color development after exposure of silver halide photographic sensitive materials to light. In this method, a color reproduction process according to a conventional subtractive process is utilized to form cyan, magenta and yellow color images which have a complementary relation with red, green and blue colors. For example, phenol derivatives or naphthol derivatives are used as couplers for formation of a cyan color image.

In the color photographic process, the color forming couplers which are added to a developer or incorporated in photosensitive emulsion layers or other color forming layers react with an oxidation product of the color developing agent formed during development to form color images. Hitherto, cyan color forming couplers are usually 4-equivalent couplers, that is, in theory they stoichiometrically require 4 mols of exposed silver halide as an oxidizing agent for formation of 1 mol of the dye. In using 4-equivalent couplers, it is necessary to incorporate a large amount of silver halide in the photosensitive layers. However, incorporation of such large amount of silver halide in the photosensitive layers causes the disadvantages that the sharpness of formed images is deteriorated because of the increase of the scattering of light in the emulsion layers and that the rate of processing the photosensitive materials is reduced because of the increased thickness of the emulsion layer. Further, in using such couplers, a strong oxidizing agent is required in the subsequent processing steps, because the formation of the dyes is not completed in the color development bath.

In order to overcome these defects, use of 2-equivalent couplers has been proposed, that is, couplers which in theory stoichiometrically require only two mols of exposed silver halide for forming 1 mol of indoaniline or indophenol dyes.

2-Equivalent couplers have the structure in which a hydrogen atom of the coupling position, that is, the p-position to a phenolic hydroxyl group is substituted with a releasable group. Examples of such a releasable group are sulfonamido groups as described in U.S. Pat. No. 3,737,316, imido groups as described in U.S. Pat. No. 3,749,735, sulfonyl groups as described in U.S. Pat. No. 3,622,328, aryloxy groups as described in U.S. Pat. No. 3,476,563 and a cyanoacetamido group as described in U.S. Pat. No. 3,808,945.

However, these couplers are not always satisfactory, because they have defects that their coupling reactivity is insufficient, that their dispersibility is poor, thereby giving rise to coating difficulties, that their synthesis is very difficult and that the storability of the formed color images is poor, etc.

Referring particularly to U.S. Pat. No. 3,808,945, which discloses a 2-equivalent naphthol type coupler having a cyanoacetamido group as a releasable group, the coupler provides an extremely poor maximum color density, as will be shown in Example 1 hereinafter, as compared to the coupler of the present invention due to the cyanoacetamido group of the prior art being derived from a carboxylic acid having a pKa outside the critical range set forth in the present invention. Further, only from similarity in structure of releasable groups, U.S. Pat. No. 3,291,609 may be considered to be the prior art since it discloses phenol type compounds having amido groups. The phenol type compounds taught in U.S. Pat. No. 3,291,609 are, however, distinguishable over the coupler of the present invention because the phenol type compounds are employed as developing agent precursors, whereas the coupler of the present invention does not act as a developing agent. While it lacks a definite proof, this is believed due to difference in reduction-oxidation balance required in acting as a developing agent.

SUMMARY OF THE INVENTION

A first object of the present invention is to provide novel photographic color forming couplers.

A second object of the present invention is to provide 2-equivalent cyan color forming couplers having good dispersibility which are suitable for producing photosensitive materials for subtractive color photographic process and which do not give rise to coating difficulties.

A third object of the present invention is to provide a process for forming cyan color images which comprises developing exposed silver halide emulsions in the presence of novel cyan color forming couplers.

A fourth object of the present invention is to provide color photographic sensitive materials with a silver halide emulsion layer containing novel cyan color forming couplers.

A fifth object of the present invention is to provide a means for improving the sharpness of the resulting images which comprises decreasing the amount of silver halide present in photographic emulsions by using novel cyan color forming couplers.

A sixth object of the present invention is to provide 2-equivalent cyan color forming couplers which have good spectral absorption characteristics and which have good stability to heat and high humidity for a long period of time.

A seventh object of the present invention is to provide cyan color forming couplers which form images having high sensitivity, high gamma and high density, especially high maximum density, by color development.

It has now been found that the above described objects are attained with a photographic oupler represented by the following formula (I)

$$[A] - NHCOR$$

wherein A represents a cyan color forming coupler residue having a naphthol nucleus or a phenol nucleus; the RCONH- group is substituted in the coupling position of [A], and R represents (1) an aliphatic hydrocarbon or alicyclic hydrocarbon group which has at least one electron attractive substituent in the $\alpha$-position to the carbonyl group in the RCONH- group, or (2) an aryl group, a heterocyclic group, an alkoxycarbonyl group, an aryloxycarbonyl group, a carbamoyl group, an acyl group or an amino group which may be substituted with one or more electron attractive substituents and R as defined in (1) and (2) above is a residue derived from a carboxylic acid of the formula RCOOH having a pKa of about 1.3 or less. Phrased another way, if the "NHCOR" amide were converted to the corresponding acid, that acid would have a pKa of about 1.3 or less. The corresponding acid, RCOOH, is hereafter sometimes referred to as "parent acid".

DETAILED DESCRIPTION OF THE INVENTION

In the formula (I), [A] represents a cyan color forming coupler residue having a naphthol nucleus or a phenol nucleus, and the coupler residue may be substituted with conventionally used substituents in addition to the group RCONH-. The group RCONH- is a substituent which is substituted at the coupling position of the coupler residue [A]. R represents (1) an aliphatic hydrocarbon or alicyclic hydrocarbon group having at least one electron attractive substituent in the $\alpha$-position to the carbonyl group in the RCONH- group, for example, an aliphatic hydrocarbon group having 1 to 32, preferably 1 to 8 carbon atoms, for example, a straight or branched chain alkyl group such as methyl, ethyl, isopropyl, hexyl, or an alkenyl group such as $\beta$-vinylethyl, an alicyclic hydrocarbon having 1 to 32, preferably 1 to 8 carbon atoms, for example, a cycloalkyl group such as cyclohexyl, or a cycloalkenyl group such as cyclopentenyl, and the like; or (2) an aryl group such as phenyl or $\beta$-naphthyl, a heterocyclic group, for example, a 5- or 6-membered heterocyclic group or condensed heterocyclic group containing at least one hetero atom selected from nitrogen, oxygen and sulfur atoms, such as a furyl, oxazolyl, benzothiazolyl, imidazolyl, an alkoxycarbonyl group having 1 to 8 carbon atoms in the alkoxy moiety such as methoxycarbonyl or ethoxycarbonyl, an aryloxycarbonyl group such as phenoxycarbonyl, a carbamoyl group, for example, an N-alkyl carbamoyl group such as N-ethylcarbamoyl, or an N-arylcarbamoyl group such as N-phenylcarbamoyl, or an N,N-dialkylcarbamoyl group such as N,N-diethylcarbamoyl or an N-alkyl-N-arylcarbamoyl group such as N-methyl-N-phenylcarbamoyl, or an N,N-diarylcarbamoyl group such as N,N-diphenylcarbamoyl, and the like, an acyl group, for example, an alkylcarbonyl group such as acetyl, butyryl, or an arylcarbonyl group such as phenylcarbonyl, and the like or an amino group such as ethylamino, dimethylamino, N-methylanilino, anilino and the like, which may be substituted with one or more electron attractive substituents.

R defined as above is a residue derived from a carboxylic acid of the formula RCOOH having a pKa of about 1.3 or less. It is of great importance for the parent acid to possess a pKa of about 1.3 or less. If the pKa value exceeds 1.3, the maximum color density becomes extremely poor when images are obtained from such a coupler as having pKa greater than 1.3. Examples of the electron attractive substituents include a halogen atom (e.g., chlorine, bromine or fluorine), a nitro group, a cyano group, a carbonyl-containing group (e.g., an acyl group, an alkoxycarbonyl group, an aryloxycarbonyl group or a carbamonyl group as defined above), a carboxyl group, a sulfo group and a sulfonyl-containing group such as a sulfamoyl group (e.g., ethylsulfamoyl, phenylsulfamoyl), an alkylsulfonyl group (e.g., methylsulfonyl), an arylsulfonyl group (e.g., phenylsulfonyl), an alkoxysulfonyl group (e.g., ethyoxysulfonyl), or an aryloxysulfonyl group (e.g., phenoxysulfonyl).

Preferably the aliphatic hydrocarbon group and the alicyclic hydrocarbon group for R of RCONH- in the formula (I) have 1 to 32 preferably 1 to 8, carbon atoms wherein one hydrogen atom in at least the $\alpha$-position to the carbonyl group is substituted with an electron attractive substituent such as a nitro group, a cyano group, a carbonyl containing group (e.g., an acyl group, an alkoxycarbonyl group, an aryloxycarbonyl group or a carbomoyl group), a carboxyl group, a sulfonyl-containing group (e.g., a sulfamoyl group, an alkylsulfonyl group, an arylsulfonyl group or an alkoxysulfonyl group) or a sulfo group, etc., or two hydrogen atoms in at least the $\alpha$-position to the carbonyl are substituted with halogen atoms. Preferred examples of aryl groups are monocyclic or bicyclic aryl groups which may be substituted with one or more of a halogen atom, a nitro group, a cyano group, a carbonyl containing group (e.g., acyl, alkoxycarbonyl, aryloxycarbonyl or carbamoyl), a carboxyl group, a sulfo group and a sulfonyl containing group (e.g., alkoxysulfonyl, alkylsulfonyl, aryloxysulfonyl and sulfamoyl). Suitable examples of heterocyclic groups include heterocyclic nuclei such as tetrazole, triazole, isoxazole, thiazole, pyridazine, pyrimidine, furan, pyrazine, thiophene, pyrrole, pyrone, pyridine, benzimidazole, indole, quinoline, acrydine, pyrazole, naphthylidine or xanthene, etc., nuclei which may be substituted with one or more of a halogen atom, a nitro group, a cyano group, a carbonyl containing group (e.g., acyl, alkoxycarbonyl, aryloxycarbonyl or carbamoyl), a carboxyl group, a sulfo group and a sulfamoyl (e.g., alkylsulfamoyl such as methylsulfamoyl and arylsulfamoyl such as phenylsulfamoyl) group. The alkoxycarbonyl, aryloxycarbonyl, carbamoyl, aryl and amino groups can also be substituted.

In the formula (I), cyan color forming couplers comprising a naphthol nucleus as a basic skeleton and having the -NHCOR group wherein R represents the substituents described in (1) above or represents (2) and the substituents R are residues of a carboxylic acid (R COOH) having a pKa of about 1.3 or less are particularly preferred in providing images having improved maximum color density by color development.

A characteristic of the photographic cyan color forming couplers according to the present invention is that the basic skeleton of these couplers comprises a phenol or naphthol nucleus and a hydrogen atom of the coupling position, that is, the p-position to the phenolic hydroxyl group, is replaced with an acylamino group. This acylamino group can be released on formation of an indoaniline or indophenol dye by an oxidation-coupling reaction of the cyan color forming 2-equivalent couplers of the present invention with an aromatic primary amino developing agent. Further, a characteristic of the cyan color forming 2-equivalent coupler is that this acylamino releasable group in the formula (I) is the substituent described above or the acylamino group derived from a carboxylic acid having a pKa of about 1.3 or less.

Of the cyan color forming couplers of the present invention preferred couplers are represented by the following formulae (II) and (III).

$$R_1 - [A_1] - NHCOR_3 \qquad (II)$$

$$R_2 - [A_2] - NHCOR_4 \quad (III)$$

In the formulae, $[A_1]$ and $[A_2]$ represent a phenol type cyan color forming coupler residue and a naphthol type cyan color forming coupler, respectively. $[A_1]$ may be substituted with other substituents in addition to $R_1$ and $-NHCOR_3$ and $[A_2]$ may be substituted with other substituents in addition to $R_2$ and $-NHCOR_4$.

$R_3$ and $R_4$ each represents an aliphatic hydrocarbon group substituted with an electron attractive substituent, an aryl group or a heterocyclic group, which is a residue of a carboxylic acid of the formula $R_3COOH$ and $R_4COOH$, respectively, having a pKa of about 1.3 or less.

Examples of $R_3$ and $R_4$ include aliphatic hydrocarbon groups such as alkyl groups wherein at least two hydrogen atoms of the α-position to the carbonyl group are replaced by halogen atoms (such as fluorine or chlorine) or wherein at least one hydrogen atom of the α-position is replaced by halogen substituted alkyl and aryl groups (for example, dichloromethyl, trichloromethyl, trifluoromethyl, octafluoromethyl, octafluorobutyl, pentafluorophenyl and trichlorophenyl, etc.), nitro substituted aryl groups (for example, 2-nitrophenyl and 2,4-dinitrophenyl, etc.), and electron attractive heterocyclic groups, for example, pyron-2-yl, 1-methyl-tetrazol-5-yl, indol-2-yl, 5-nitrofuran-2-yl, 3,4-dichlorofuran-2-yl and 5-phenylisoxazol-2-yl, etc.).

$R_1$ is a substituent in the 2-position of the phenol nucleus and represents a hydrogen atom, an alkyl group having 30 or less carbon atoms and particularly an alkyl group having 1 to 20 carbon atoms (such as methyl, isopropyl, pentadecyl or eicosyl, etc.), an alkoxy group having 30 or less carbon atoms and particularly an alkoxy group having 1 to 20 carbon atoms (such as methoxy, isopropoxy, pentadecyloxy or eicosyloxy, etc.), an alkylthio group having 30 or less carbon atoms, preferably 1 to 20 carbon atoms, in the alkyl moiety (such as methylthio, isopropylthio, hexadecylthio, etc.), an aryloxy group (such as phenoxy or p-tert-butylphenoxy, etc.), an amino group and an acylamino group represented by the formulae (IV) to (VII):

$$-NH - CO - X \quad (IV)$$

$$-NH - SO_2 - X \quad (V)$$

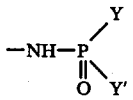
(VI)

$$-NHCONH - X \quad (VII)$$

In the formula (IV) to (VII), X represents a straight or branched chain alkyl group having 1 to 32 and preferably 1 to 20 carbon atoms (for example, methyl, ethyl, isopropyl, 2-ethylhexyl, tetradecyl, etc.), an alicyclic hydrocarbon group (for example, cyclopropyl, cyclohexyl or norbornyl, etc.) or an aryl group (for example, phenyl or naphthyl, etc.). The above described alkyl group and aryl group may be substituted with one or more of a halogen atom (for example, chlorine, bromine, fluorine), a nitro group, a cyano group, a hydroxyl group, a carboxyl group, an amino group (for example, amino, alkylamino such as butylamino, methylamino, dialkylamino such as diethylamino, dibutylamino, anilino or N-alkylanilino such as N-ethylanilino, N-propylanilino, etc.), an aryl group (for example, phenyl, naphthyl), an alkoxycarbonyl group (for example, ethoxycarbonyl, benzyloxycarbonyl), an acyloxycarbonyl group (for example, acetyloxycarbonyl, benzoyloxycarbonyl), an amido group (for example, acetamido, alkylcarbamido such as methylcarbamido, hexylcarbamido, isopropylcarbamido, arylcarbamido such as phenylcarbamido, 4-tert-butylphenylcarbamido, alkylsulfonamido such as butylsulfonamido, methanesulfonamido, arylsulfonamido such as phenylsulfonamido, naphthylsulfonamido, etc.), an imido group (for example, succinimido etc.), a carbamoyl group (for example, ethylcarbamoyl, N,N-dimethylcarbamoyl, N-methyl-N-phenylcarbamoyl, etc.), a sulfamoyl group (for example, N,N-diethylsulfamoyl, etc.), an alkoxy group (for example, ethoxy or octadecyloxy, etc.), and an aryloxy group (for example, phenoxy, p-tert-butylphenoxy or 4-hydroxy-3-tert-butylphenoxy, etc.).

Y and Y' each represents the groups described above for S, or an —OX group, an —NHX group or an $-NX_2$ group, wherein X is as defined above.

$R_2$ is substituted in the 2-position of the naphthol nucleus and represents a hydrogen atom, an alkyl group having 30 or less carbon atoms and preferably an alkyl group having 1 to 20 carbon atoms, and an carbamoyl group represented by the following formulae (VIII) and (IX).

$$- CO - NH - X \quad (VIII)$$

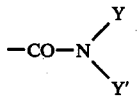
(IX)

In the formulae, X, Y and Y' each has the same meaning as described in the formulae (IV), (V), (VI) and (VII).

Of the compounds represented by the above formulae (II) and (III), compounds represented by the following formulae (X) and (XI) are particularly preferred.

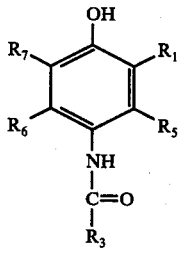
(X)

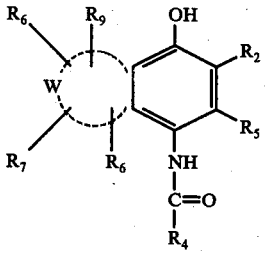
(XI)

In the formulae, $R_1$, $R_2$, $R_3$ and $R_4$ each has the same meaning as defined in the formulae (II) and (III). $R_5$, $R_6$, $R_7$, $R_8$ and $R_9$ which may be the same or different, each represents a hydrogen atom, a halogen atom, an alkyl group, an aryl group, an alkoxy group, an alkylthio group, a heterocyclic group, an amino group, a carbonamido group, a sulfonamido group, a sulfamoyl group or a carbamoyl group. W represents a group of non-metal atoms necessary to form a 5- or 6-membered ring.

Specific examples of $R_5$, $R_6$, $R_7$, $R_8$ and $R_9$ include a hydrogen atom, a primary, secondary and tertiary alkyl group having 1 to 22 carbon atoms (for example, an unsubstituted alkyl group such as methyl, isopropyl, n-butyl, tert-butyl, hexyl, dodecyl, etc., and a substituted alkyl group such as 2-chlorobutyl, 2-hydroxyethyl, 2-phenylethyl, 2-(2,4,6-trichlorophenyl)ethyl and 2-aminoethyl, etc., etc., an aryl group (for example, an unsubstituted or substituted aryl group such as phenyl, 4-methylphenyl, 2,4,6-trichlorophenyl, 3,5-dibromophenyl, 2-trifluoromethylphenyl, naphthyl, 2-chloronaphtyl and 3-ethylnaphthyl, etc.), a heterocyclic group (for example, benzofuranyl, furanyl, thiazoyl, benzothiazolyl, naphthothiazolyl, oxazolyl, benzoxazolyl, naphthoxazolyl, pyridyl and quinolyl, etc.), an amino group (for example, amino, alkylamino (such as methylamino, diethylamino, dodecylamino, etc.), arylamino (such as phenylamino, 4-(3-sulfobenzamido)anilino, 4-cyanophenylamino, 2-trifluoromethylphenylamino, etc.), and heterocyclic amino (such as benzothiazolamino, etc.), etc., a carbonamido group (for example, alkylcarbonamido (such as ethylcarbonamido, decylcarbonamido, phenylethylcarbonamido, etc.), arylcarbonamido (such as phenylcarbonamido, 2,4,6-trichlorophenylcarbonamido, 4-methylphenylcarbonamido, 2-ethoxyphenylcarbonamido, 3-(α-(2,4-di-tert-amylphenoxy)acetamido)-benzamido, naphthylcarbonamido, etc.), heterocyclic carbonamido (such as thiazolylcarbonamido benzothiazolylcarbonamido, naphthothiazolylcarbonamido, oxazolylcarbonamido, benzoxazolylcarbonamido, imidazolylcarbonamido, benzimidazolylcarbonamido, etc.), etc.), a sulfonamido group (for example, alkylsulfonamido (such as butylsulfonamido, dodecyl sulfonamido, phenylethylsulfonamido, etc.), arylsulfonamido (such as phenylsulfonamido, 2,4,6-trichlorophenylsulfonamido, 2-methoxyphenylsulfonamido, 3-carboxyphenylsulfonamido, naphthylsulfonamido, etc.), heterocyclic sulfonamido (such as thiazolylsulfonamido, benzothiazolylsulfonamido, imidazoylsulfonamido, benzimidazolylsulfonamido, and pyridylsulfonamido, etc.), etc.), a sulfamoyl group (for example, alkylsulfamoyl (such as propylsulfamoyl, octylsulfamoyl octadecylsulfamoyl, etc.), arylsulfamoyl (such as phenylsulfamoyl, 2,4,6-trichlorophenylsulfamoyl, 2-methoxyphenylsulfamoyl, naphthylsulfamoyl, etc.), heterocyclic sulfamoyl (such as thiazolylsulfamoyl, benzothiazolylsulfamoyl, oxazolylsulfamoyl, benzimidazolylsulfamoyl, pyridylsulfamoyl, etc.), etc., and a carbamoyl group (for example, alkylcarbamoyl (such as ethylcarbamoyl, octylcarbamoyl, pentadecylcarbamoyl, octadecylcarbamoyl, etc.), arylcarbamoyl (such as phenylcarbamoyl, 2,4,6-trichlorophenylcarbamoyl, etc.), heterocyclic carbamoyl such as thiazolylcarbamoyl, benzothiazolylcarbamoyl, oxazolylcarbamoyl, imidazolylcarbamoyl benzimidazolylcarbamoyl, etc.), etc.). W represents the non-metal atoms necessary to form a condensed 5- or 6-membered ring (for example, a hydrocarbyl ring (such as a benzene ring, a cyclohexene ring, a cyclopentene ring, etc.) or a heterocyclic ring (such as a thiazole ring, an oxazole ring, an imidazole ring, a pyridine ring, a pyrrole ring a tetrahydropyridine ring, etc.), etc.).

The pKa as used herein is defined as the common logarithm of the reciprocal of the equilibrium constant K in the reaction by which a proton of the carboxylic acid of the formula R-COOH is dissociated from the carboxylic acid. The pKa is well known and can be easily determined by persons skilled in the art, e.g., as described in I. M. Kolthoff and N. F. Furman, *Potentimetric Titrations,* 3rd Edition, John Wiley and Sons Inc., New York (1949), I. M. Kolthoff and H. A. Laitinen, *pH and Electro-Titrations,* 2nd Edition, New York (1948) and A. Albert and E. P. Serjeant, *Ionization Constants of Acid and Bases,* Methuen and Co., Ltd., London (1962). The importance of the pKa in the present invention will be understood from the following explanation.

Photosensitive film samples were produced using Coupler (4) Coupler (9) and Coupler (10) described hereinafter and Comparison Coupler (A), p-acetylaminophenol, and Comparison Coupler (B), 1-hydroxy-4-chloroacetamido-N-[γ-(2,4-di-tert-amylphenoxy)propyl]-2-naphthamide, respectively, in the same manner as described in Example 1 hereinafter, and they were subjected to sensitometry. The film prepared using Coupler (4) had an excellent color forming ability, and the films prepared using Couplers (9) and (10) had a good color forming ability, while the films prepared using Comparison Couplers (A) and (B) were hardly colored. Further, the relative coupling rates of these couplers based on known Coupler (C), 1-(2,4,6-trichlorophenyl)-3-{3-[(2,4-di-t-amylphenoxy)acetamino]-benzamido}-5-pyrazolone, as a standard were determined under the sensitometric conditions shown in Example 1 hereinafter in the same manner as that described in U.S. Pat. No. 3,928,044. The relative coupling rate was 0.30 in the case of Coupler (4), while it could not be determined in the case of Coupler (A).

Further, for the purposes of demonstrating the criticality of the pKa value in the present invention, a photosensitive film sample was also produced using Comparison Coupler (D), 1-hydroxy-4-cyanoacetamino-N-[γ-(2,4-di-tert-amylphenoxy)propyl]-2-naphthamide, in the same manner as described in Example 1 hereinafter, and it was subjected to sensitometry. The relative coupling rate could not be determined in this case due to the same reason as in Comparison Coupler (B).

Table 1

| Examination No. | Coupler Used | pKa of RCOOH | Color Formation | Relative Coupling Rate |
|---|---|---|---|---|
| 1 | Coupler (4) | 0.2 | Good | 0.03 |
| 2 | Coupler (9) | 0.6 | Good | 0.50 |
| 3 | Coupler (10) | 1.3 | Good | 0.25 |
| 4 | Coupler (A) | 4.8 | Bad | Impossible to determine |
| 5 | Coupler (B) | 2.9 | Inferior | Too low to determine |
| 6 | Coupler (D) | 2.4 | Inferior | Too low to determine |

It can be understood from the results shown in Table 1 that the pKa is important in the present invention.

Examples of the couplers of the present invention are shown below. However, the present invention is not to be construed as being limited to these examples.

Coupler (1)

2,6-Dimethyl-4-pentafluorobenzamidophenol

Coupler (2)

3-Methoxy-4-(2,2,3,3,4,4,5,5-)octafluorovaleramidophenol

Coupler (3)

1-Hydroxy-4-trichloroacetamido-N-n-octadecyl-2-naphthamide

Coupler (4)

1-Hydroxy-4-(2,2,3,3,4,4,5,5-)octafluorovaleramido-N-[γ-(2,4-di-tert-amylphenoxy)propyl]-2-naphthamide Coupler (5)

2-Methoxy-4-pentachlorobenzamidophenol

Coupler (6)

2-Chloro-3-methyl-4-trifluoroacetamido-6-[α-(2,4-di-tert-amylphenoxy)butyramido]phenol Coupler (7)

1-Hydroxy-4-pentafluorobenzamido-N-[γ-(2,4-di-tert-amylphenoxy)propyl]-2-naphthamide Coupler (8)

1-Hydroxy-4-heptafluorobutyramido-3'-[α-(3-tert-butyl-4-hydroxyphenoxy)tetradecanamido]-2-naphthanilide Coupler (9)

1-Hydroxy-4-trichloroacetamido-N-[γ-(2,4-di-tert-amylphenoxy)propyl]-2-naphthamide Coupler (10)

1-Hydroxy-4-dichloroacetamido-N-[γ-(2,4-di-tert-amylphenoxy)propyl]-2-naphthamide Coupler (11)

2,6-Dimethyl-4-trichloroacetamidophenol

Coupler (12)

1-Hydroxy-4-(2-nitrobenzamido)-2-naphthanilide

Coupler (13)

1-Hydroxy-4-(5-nitro-2-furoylamino)-2'-chloro-5'-n-tetradecyloxy-2-naphthanilide Coupler (14)

1-Hydroxy-4-(2-comanoylamino)-N-[γ-(2,4-di-tert-amylphenoxy)propyl]-2-naphthamide Coupler (15)

2,4-(bis-(2,2,3,3,4,4,5,5-)Octafluorovaleramido)-5-[α-(2,4-di-tert-amylphenoxy)butyramido]phenol Of these couplers, Couplers (3), (4), (7), (8) (9), (10) and (12) are particularly preferred. Couplers (3), (4), (7), (8) and (9), all of which have halogen-substituents on the releasable group, are most preferred.

The general procedure for preparing the cyan color forming couplers of this invention having the formula (I) can be illustrated by the reaction scheme:

$$[A] - NH_2 + RCOCl \rightarrow [A] - NHCOR$$

wherein A and R are as defined previously. In this procedure, an equimolar amount of a compound of the formula [A]—$NH_2$, which can be obtained by substituting a hydrogen atom at a coupling position of a phenol or naphthol nuclei with an amino group, and an acid chloride of the formula RCOCl are dispersed in acetonitrile, and the resulting dispersion is heated for about 4 to 6 hours in the presence of a base such as triethylamine as an acid acceptor for the hydrochloric acid formed in the reaction to obtain the desired coupler of the formula (I). The amino compound of the formula [A]—$NH_2$ used as a starting material in the above procedure can be prepared by nitrating a 4-equivalent coupler of the phenol-type or the naphthol-type represented by the formula [A]—H, wherein A is as defined previously, with nitric acid having a specific gravity of 1.38 in acetic acid at room temperature to introduce a nitro group into the coupling position, and reducing the resulting nitro compound of the formula [A]—$NO_2$ with reduced iron in approximately the same weight as that of the nitro compound at a temperature of about 80° C to obtain the desired starting material of the formula [A]—$NH_2$.

Typical examples of the synthesis of the cyan color forming couplers of the present invention are shown in the following. Unless otherwise indicated herein all parts, percents, ratios and the like are by weight.

SYNTHESIS EXAMPLE 1

Synthesis of 1-Hydroxy-4-(2,2,3,3,4,4,5,5-)octafluorovaleramido-N-[γ-(2,4-di-tert-amylphenoxy)-propyl]-2-naphthamide (Coupler (4)).

(a) Synthesis of 1-Hydroxy-4-nitro-N-[γ-(2,4-di-tert-amylphenoxy)-propyl]-2-naphthamide 100 g of 1-hydroxy-N-[γ-(2,4-di-tert-amylphenoxy)-propyl]-2-naphthamide was dissolved in 1 liter of acetic acid and nitrated at 15° - 18° C using 23 g of a 60% nitric acid aqueous solution. After conclusion of the reaction, 1 liter of methanol was added thereto and the precipitated crystals were separated by filtration. Thus, 70 g of the object compound were obtained. The melting point was 209° - 210° C.

(b) Synthesis of 1-Hydroxy-4-amino-N-[γ-(2,4-di-tert-amylphenoxy)-propyl]-2-naphthamide 50 g of 1-hydroxy-4-nitro-N-[γ-(2,4-di-tert-amylphenoxy)propyl]-2-naphthamide obtained in Step (a) above was reduced in 500 ml of a 90% acetic acid aqueous solution using 50 g of reduced iron. The reaction mixture was poured into water and extracted with ethyl acetate. After removal of the ethyl acetate by distillation, the residue was recrystallized from ligroin to obtain 40 g of the object compound. The melting point was 132° - 133° C.

(c) Synthesis of 1-Hydroxy-4-amino-N-[γ-(2,4-di-tert-amylphenoxy)-propyl]-2-naphthamide 14.3 g of 1-hydroxy-4-amino-N[γ-(2,4-di-tert-amylphenoxy)propyl]-2-naphthamide obtained in Step (b) above, 8.5 g of (2,2,3,3,4,4,5,5-)octafluorovaleryl chloride and 3.2 g of triethylamine were added to 500 ml of acetonitrile and the mixture was refluxed for 6 hours. After conclusion of the reaction, the reaction solution was condensed to 100 ml and water was added thereto. The solution was then extracted with ethyl acetate. After removal of the ethyl acetate by distillation, the residue was recrystallized from ligroin to obtain the object compound. Yield: 15 g. Melting point: 120° - 123° C.

SYNTHESIS EXAMPLE II

Synthesis of 1-Hydroxy-4-trichloroacetamido-N-[γ-(2,4-di-tert-amylphenoxy)propyl]-2-naphthamide (Coupler (9)).

14.3 g of 1-hydroxy-4-amino-N-[γ-(2,4-di-tert-amylphenoxy)propyl]-2-naphthamide obtained in Step (b) of Synthesis I, 6 g of trichloroacetyl chloride and 3.3 g of triethylamine were added to 300 ml of acetonitrile, and the mixture was refluxed for 4 hours. After conclusion of the reaction, the reaction solution was condensed to 100 ml and water was added thereto. The solution was then extracted with ethyl acetate. After removal of the ethyl acetate by distillation, n-hexane was added to the residue. The solid precipitate was separated by filtration and recrystallized from ethanol to obtain the object compound. Yield: 10 g. Melting point: 190° - 192° C.

Some of the couplers of the present invention are non-diffusible and yield nondiffusible dyes. Accordingly, they can be used for any photographic elements which contain image forming couplers. Further, some of the couplers of the present invention can form color images in hydrophilic colloid-silver halide photographic emulsion layers at color development by incorporating the couplers in the color developer or by adding the couplers to the emulsion layers.

In order to produce silver halide color photographic sensitive materials using the couplers of the present invention, the couplers can be used individually or two or more of the couplers can be used as a mixture. Generally, the couplers of the present invention can be employed, in an amount of about 0.001 to 100 mol%, preferably 0.01 to 10 mol% per mole of the silver halide. Further, the couplers can be used in combination with other cyan color forming couplers such as naphthol type and phenol type couplers described in U.S. Pat. Nos. 2,474,293 and 2,698,794, naphthol type couplers described in Japanese Patent Publication Nos. 5547/1964 and 6993/1970 or cyan couplers described in U.S. Pat. Nos. 2,369,929, 2,698,794, 2,895,826, 3,311,476, 3,458,315, 3,560,212, 3,582,322, 3,591,383, 3,386,301, 2,434,272, 2,706,684, 3,034,892, and 3,583,971, German Patent Application (OLS) No. 2,163,811, Japanese Patent Publication No. 2S836/1970 and Japanese Patent Application No. 33238/1973. These conventional cyan couplers can be used in a proportion of about 0.01 to 100 mol% per mole of the coupler of this invention.

In addition, it is possible to add a coupler which releases a development inhibiting compound (a so-called DIR coupler) or a compound which releases a development inhibiting compound. Examples of such materials are described in U.S. Pat. Nos. 3,148,062, 3,227,554, 3,253,924, 3,617,291, 3,622,328 and 3,705,201, British Pat. No. 1,201,110 and U.S. Pat. Nos. 3,297,445, 3,379,529 and 3,639,417. These conventional DIR couplers can be used in a proportion of about 0.001 to 10 mol%, preferably 0.01 to 1 mol% per mole of the coupler of this invention.

Further, in color photographic sensitive materials containing the couplers of the present invention, it is possible to use the following yellow couplers or magenta couplers.

Open-chain diketomethylene compounds are widely used as yellow couplers. Examples of these compounds include those described in U.S. Pat. Nos. 3,341,331, 2,875,057 and 3,551,155, German Patent Application (OLS) No. 1,547,868, U.S. Pat. Nos. 3,265,506, 3,582,322 and 3,725,072, German Patent Application (OLS) No. 2,162,899, U.S. Pat. Nos. 3,369,895 and 3,408,194 and German Patent Application (OLS) Nos. 2,057,941, 2,213,461, 2,219,917, 2,261,361 and 2,263,875.

Although 5-pyrazolone compounds are mainly used as magenta couplers, imidazolone compounds and cyanoacetyl compounds can be used as well. Examples of these couplers include those described in U.S. Pat. Nos. 2,439,098, 2,600,788, 3,062,653, and 3,558,319, British Pat. No. 956,261, U.S. Pat. Nos. 3,582,322, 3,615,506, 3,519,429, 3,311,476 and 3,419,391, Japanese Patent Application Nos. 21454/1973 and 56050/1973, German Pat. No. 1,810,464, Japanese Patent Publication 2016/1969, Japanese Patent Application No. 45971/1923 and U.S. Pat. No. 2,983,608.

Two or more of the above described couplers can be used in the same layer so as to achieve the desired characteristics for the photosensitive material. Alternatively, the same coupler can be added to two or more different layers.

The silver halide emulsions used in the present invention can be produced by mixing a solution of a water-soluble silver salt (for example, silver nitrate) with a solution of a water-soluble halogen salt (for example, potassium bromide) in the presence of a solution of a hydrophilic high molecular weight material such as gelatin. Examples of suitable silver halides include silver chloride and silver bromide and also mixed silver halides such as silver bromochloride, silver iodobromide and silver iodobromochloride. The grains of these silver halides can be in the form of a cubic system, octahedral system or a mixed crystal system. A uniform grain size is not necessary. These silver halide grains can be produced according to known conventional processes. For example they can be produced using a single or double jet process or a control double jet process. Two or more silver halide photographic emulsions which were previously prepared can also be mixed.

Further, the silver halide grains can have a homogeneous crystal structure or a stratum structure wherein the interior and the outer portion thereof are different, or can be the so-called conversion type grains described in British Patent Publication 635,841 or U.S. Pat. No. 3,622,318. Further, silver halide grains wherein latent images are formed on the surface thereof or those wherein latent images are formed in the interior thereof can be used. Examples of these photographic emulsions are described in C. E. K. Mees & T. H. James, *The Theory of the Photographic Process,* 3rd Ed., MacMillan Co., New York (1966) and P. Grafkides, *Chimie Photographique,* Paul Montel Co., Paris (1957), and can be prepared by various processes such as an ammonia process, a neutral process or an acid process, etc.

After formation of the silver halide grains, the by-produced water-soluble salts (for example, potassium nitrate where silver bromide is produced using silver nitrate and potassium bromide) are removed from the system by washing with water. Then, the grains can be subjected to heating in the presence of a chemical sensitizer such as sodium thiosulfate, N,N,N'-trimethyl thiourea, aurous thiocyanate complex salt, aurous thiosulfate complex salt, stannous chloride or hexamethylenetetramine to increase the sensitivity without coarsening the grains. This method is also described in Mees and James, supra, and Grafkides, supra.

Each layer of the photographic sensitive materials can be coated using various coating methods including a dip coating method, an air-knife coating method, a curtain coating method or an extrusion coating method using a hopper as described in U.S. Pat. 2,681,294.

If desired, two or more layers can be coated at the same time using the process described in U.S. Pat. Nos. 2,761,791, 3,508,947, 2,941,898 and 3,526,528.

Examples of hydrophilic high molecular weight materials used in the photosensitive layers of the present invention include, for example, gelatin, colloidal albumin, casein, cellulose derivatives such as carboxymethyl cellulose or hydroxyethyl cellulose, agar-agar, sodium alginate, saccharide derivatives such as starch derivatives, and synthetic hydrophilic colloids such as polyvinyl alcohol, poly-N-vinylpyrrolidone, polyacrylic acid copolymers, polyacrylamide and the derivatives thereof or the partially hydrolyzed products thereof, etc. If desired, a compatible mixture of two or more of these colloids can be used. Of these materials, gelatin is most commonly used. However, a portion or all of the gelatin can be replaced by not only a synthetic high molecular weight material but also by a gelatin derivative, that is, a gelatin modified with a compound reactive with the amino groups, imino groups, hydroxyl groups or carboxyl groups present as functional groups in the gelatin molecule or with a graft polymer of gelatin wherein the molecular chains of other high molecular weight material have been grafted.

Examples of compounds for preparing the above described gelatin derivatives include, for example, isocyanates, acid chlorides and acid anhydrides described in U.S. Pat. No. 2,614,928, acid anhydrides described in U.S. Pat. No. 3,118,766, bromoacetic acids described in Japanese Patent Publication 5514/1964, phenyl glycidyl ethers described in Japanese Patent Publication No. 26845/1976, vinyl sulfone compounds described in U.S. Pat. No. 3,132,945, N-allyl vinylsulfonamides described in British Pat. No. 861,414, maleinimide compounds described in U.S. Pat. No. 3,186,846, acrylonitriles described in U.S. Pat. No. 2,594,293, polyalkylene oxides described in U.S. Pat. No. 3,312,553, epoxy compounds described in Japanese Patent Publication No. 26845/1967, acid esters described in U.S. Pat. No. 2,763,639 and alkane sultones described in British Pat. No. 1,033,189.

Examples of high molecular weight materials which can be grafted to gelatin are described in U.S. Pat. Nos. 2,831,767 and 2,956,884, *Polymer Letters*, 5, 595 (1967), *Phot. Sci. Eng.*, 9, 148 (1965) and *J. Polymer Sci.*, A-1, 9, 3199 (1971), and polymers or copolymers of vinyl monomers such as acrylic acid, methacrylic acid, the esters, amides and nitriles of these acids or styrene can be widely used as such a material. However, hydrophilic vinyl polymers which are compatible with gelatin, such as polymers or copolymers of acrylamide, acrylic acid, methacrylamide, hydroxyalkyl acrylates and hydroxyalkyl methacrylates, etc. are particularly preferred.

If desired, the photographic emulsions can be spectrally sensitized or supersensitized using cyanine dyes such as cyanine, merocyanine or carbocyanine dyes, individually or in combination, or using a combination of these dyes and a styryl dye. These color sensitization techniques are well known hitherto and described in, for example, U.S. Pat. Nos. 2,493,748, 2,519,001, 2,977,229, 3,480,434, 3,672,897, 3,703,377, 2,688,454, 2,912,329, 3,397,060, 3,615,635 and 3,628,964, British Pat. Nos. 1,195,302, 1,242,588 and 1,293,862, West German Patent Application (OLS) Nos. 2,030,326 and 2,121,780, Japanese Patent Publication Nos. 4936/1968, 14030/1969 and 10773/1968, U.S. Pat. Nos. 3,511,664, 3,522,052, 3,527,641, 3,615,613, 3,615,632, 3,617,295, 3,635,721, and 3,694,217, and British Patents 1,137,580 and 1,216,203. These can be suitably selected depending on the purpose and use of the photosensitive materials, such as the wavelength to be sensitized or the sensitivity desired, etc.

Various compounds can be added to the above described photgraphic emulsions in order to prevent a deterioration of sensitivity or generation of fog during preparation of the photosensitive materials, during storage thereof or during processing thereof. Quite a number of known compounds such as heterocyclic compounds including 4-hydroxy-6-methyl-1,3,3a,7-tetrazaindene, 3-methylbenzothiazole and 1-phenyl-5-mercaptotetrazole, mercury containing compounds, mercapto compounds or metal salts, etc. can be used for these purposes.

Examples of the compounds which can be used are described in C. E. K. Mees & T. H. James, supra, pages 344 – 349 and the following patents: U.S. Pat. Nos. 1,758,576, 2,110,178, 2,131,038, 2,173,628, 2,697,040, 2,304,962, 2,324,123, 2,394,198, 2,444,605 - 2,444,608, 2,566,245, 2,694,716, 3,697,099, 2,708,162, 2,728,663 - 2,728,665, 2,476,536, 2,824,001, 2,843,491, 3,052,544, 3,137,577, 3,220,839, 3,226,231, 3,236,652, 3,251,691, 3,252,799, 3,287,135, 3,326,681, 3,420,668 and 3,420,668 and 3,622,339, and British Pat. Nos. 893,428, 403,789, 1,173,609 and 1,200,188.

Examples of agents for inhibiting the fading of color images which can be used in the present invention include the compounds described in Belgian Pat. No. 777,487, West German Pat. No. 1,547,684 and West German Patent Application (OLS) No. 2,146,668, and phenol or hydroquinone derivatives and precursors thereof described in U.S. Pat. Nos. 2,336,327, 2,728,659 and 2,835,579, Japanese Patent Application (OPI) No. 2128/1971 and Japanese Patent Application 75126/1973.

The photographic emulsion layers and other layers used in the present invention can contain synthetic polymer compounds, for example, water-dispersible vinyl polymer latexes and, particularly, compounds for increasing the dimensional stability of the photographic materials, either individually or as a mixture thereof or together with hydrophilic water-permeable colloids. Examples of such polymers include the compounds which have been described in U.S. Pat. Nos. 2,376,005, 2,739,137, 2,853,457, 3,062,674, 3,411,911, 3,488,708, 3,525,620, 3,635,715, 3,607,290 and 3,645,740, and British Patents 1,186,699 and 1,307,375. Of these polymers, copolymers and homopolymers of alkyl acrylates, alkyl methacrylates, acrylic acid, methacrylic acid, sulfoalkyl acrylates, sulfoalkyl methacrylates, glycidyl acrylate, glycidyl methacrylate, hydroxyalkyl acrylates, hydroxyalkyl methacrylates, alkoxyalkyl acrylates, alkoxyalkyl methacrylates, styrene, butadiene, vinyl chloride, vinylidene chloride, maleic acid anhydride and itaconic acid anhydride are commonly used. If necessary, the so-called graft type emulsion polymerization latexes which are prepared by emulsion polymerization of those vinyl compounds in the presence of a protective colloid high molecular weight material can be used.

The above described photographic emulsions can contain one or more surface active agents. Although these agents are usually used as coating assistants, they are sometimes used for other purposes such as for sensitization, improvement of photographic properties, prevention of the generation of static charges or prevention of adhesion, etc.

These surface active agents include natural surface active agents such as saponin, noionic surface active agents such as alkylene oxide, glycerin type or glycidol surface active agents, cationic surface active agents such as higher alkylamines, quaternary ammonium salts or pyridinium and other heterocyclic compounds, phosphoniums and sulfoniums, anionic surface active agents containing acid groups such as carboxylic acid groups, sulfonic acid groups, phosphoric acid groups, sulfuric acid ester groups or phosphoric acid ester groups, and ampholytic surface active agents such as amino acids, aminosulfonic acids and sulfuric acid or phosphoric acid esters of aminoalcohols.

Examples of surface active agents which can be used are described in U.S. Pat. Nos. 2,271,623, 2,240,472, 2,288,226, 2,739,891, 3,068,101, 3,158,484, 3,201,253, 3,210,191, 3,294,540, 3,415,649, 3,441,413, 3,442,654, 3,475,174 and 3,545,974, West German Patent Application (OLS) No. 1,942,665, British Patent Publications 1,077,317 and 1,198,450 as well as Ryohei Oda et al, *Kaimenkasseizai no Gosei to sono Oyo* (*Synthesis and Applications of Surface Active Agents*), Maki Shoten Tokyo (1964), A.M. Schwartz et al *Surface Active Agents,* Interscience Publications Incorporated (1958)), and J. P. Sisley et al *Encyclopedia of Surface Active Agents,* Vol. 2, Chemical Publishing Company (1964)).

The formation of dye images in the present invention can be achieved with various kind of photosensitive materials. One process comprises processing photosensitive materials having silver halide emulsion layers with an alkaline developer containing an aromatic primary amine color developing agent in which a coupler is dissolved in leave water-insoluble or non-diffusible dyes in the emulsion layers, that is, a color photographic process using a coupler-containing developer.

Another process comprises processing the photosensitive materials which have a silver halide emulsion layer containing a non-diffusible coupler on a support with an alkaline developer containing an aromatic primary amine color developing agent to leave water-insoluble or non-diffusible dyes in the emulsion layer.

The phenol and α-naphthol type couplers used in the present invention can be dispersed in the photographic emulsions after dissolving them in an aqueous medium or an organic solvent.

Oil soluble non-diffusible couplers used for incorporated-coupler photographic materials can be incorporated in the photosensitive materials by dissolving the couplers in an organic solvent previously and dispersing the solution in a photographic emulsion as finely divided colloid particles.

Examples of processes for dispersing the couplers suitable for practicing the present invention are described in U.S. Pat. No. 3,676,131. Of the organic solvents used for dissolving couplers, those which are difficultly-soluble in water which have a high boiling point and which are present with the couplers in the color photosensitive materials include substituted hydrocarbons, carboxylic acid esters, carboxylic acid amides, phosphoric acid esters and ethers. Examples of these solvents include di-n-butyl phthalate, di-isooctyl acetate, di-n-butyl sebacate, tricresyl phosphate, tri-n-hexyl phosphate, N,N-diethyl caprylamide, butyl-n-pentadecylphenyl ether and chlorinated paraffins. In addition to these solvents having a high boiling point, auxiliary solvents which can be removed during production of the photosensitive materials so as to assist the dissolution of the couplers can be advantageously used. Examples of suitable auxiliary solvents include propylene carbonate, ethyl acetate, butyl acetate and cyclohexanone, etc.

It is advantageous to use surface active agents for the purpose of finely dispersing these oil soluble couplers for incorporated-coupler photographic materials in hydrophilic high molecular weight materials used in the photographic emulsions. It is particularly preferred to use anionic surface active agents such as sodium cetyl sulfate, sodium p-dedecylbenzene sulfonate, sodium nonylnaphthalene sulfonate or sodium di-(2-ethylhexyl)-α-sulfosuccinate, etc. and anionic surface active agents such as sorbitan sesquioleate or sorbitan monolaurate, etc.

Homogenizers for emulsification, colloid mills and ultrasonic emulsification devices are useful for dispersing the oil-soluble couplers. Non-diffusible couplers having a carboxyl group or a sulfo group together with a ballast group in the molecule are soluble in neutral or weakly alkaline aqueous solutions. By adding such an aqueous solution to the photographic emulsion, the coupler can be incorporated in the emulsion. It has been believed that the coupler becomes non-diffusible because of the formation of micells in the hydrophilic high molecular weight material.

For increasing the stability of color photographs it is advantageous for the photosensitive materials used in the present invention to contain p-substituted phenol derivatives in their emulsion layers or adjacent layers thereof. Particularly preferred p-substituted phenol derivatives can be selected from the hydroquinone derivatives described in U.S. Pat. Nos. 2,360,290, 2,418,613, 2,675,314, 2,701,197, 2,704,713, 2,710,801, 2,728,659, 2,732,300, 2,735,765 and 2,816,028; the gallic acid derivatives described in U.S. Pat. Nos. 3,457,079 and 3,069,262 and Japanese Patent Publication No. 13496/1968; p-alkoxyphenols described in U.S. Pat. No. 2,735,765 and Japanese Patent Application (OPI) No. 4738/1972 and the p-oxyphenol derivatives described in U.S. Pat. Nos. 3,432,300, 3,573,050, 3,574,627 and 3,764,337.

The photosensitive materials used in the present invention preferably contain an ultraviolet light absorbing agent described in, for example, U.S. Pat. Nos. 3,250,617 and 3,253,921, in the emulsion layers or adjacent layers thereof so as to stabilize the images.

The hardening of the emulsion layers can be carried out according to conventional processes. Examples of suitable hardening agents include aldehyde compounds such as formaldehyde or glutaraldehyde, ketone compounds such as diacetyl or cyclopentanedione, reactive halogen containing compounds such as bis-(2-chloroethylurea), 2-hydroxy-4,6-dichloro-1,3,5-triazine and the compounds described in U.S. Pat. Nos. 3,288,775, 2,752,303, 3,125,449 and 1,167,207, reactive olefin containing compounds such as divinyl sulfone, 5-acetyl-1,3-diacryloylhexahydro-1,3,5-triazine and the compounds described in U.S. Pat. Nos. 3,635,718 and 3,232,763 or British Pat. No. 994,869, N-methylol compounds such as N-hydroxymethylphthalimide and the compounds described in U.S. Pat. Nos. 2,732,316 and 2,586,168, isocyanates as described in U.S. Pat. No. 3,103,437, aziridine compounds as described in U.S. Pat. Nos. 3,017,280 and 2,983,611, acid derivatives as described in U.S. Pat. Nos. 2,725,294 and 2,725,295, carbodiimide compounds as described in U.S. Pat. No. 3,100,704, epoxy compounds as described in U.S. Pat. No. 3,091,537, isoxazole compounds as described in U.S. Pat. Nos. 3,321,313 and 3,543,292, halocarboxy aldehydes such as mucochloric acid, dioxane derivatives such as dihydroxydioxane or dichlorodioxane, and inorganic hardening agents such as chromium alum or zirconium sulfate. Further, precursor type compounds, for example, alkali metal bisulfite-aldehyde addition products, methylol derivatives of hydantoin and primary aliphatic nitroalcohols, etc., can be used instead of the above described compound.

The photographic emulsions can be coated on substantially planar materials which do not undergo any substantial dimensional change during processing, for example, rigid supports such as glass, metal or porcelain or flexible supports, etc. Typical examples of flexible supports include cellulose nitrate films, cellulose acetate films, cellulose acetate butyrate films, cellulose acetate propionate films, polystyrene films, polyethylene terephthalate films, polycarbonate films, laminates of these films, thin glass films and paper, etc. Further, paper coated or laminated with baryta or α-olefin polymers and particularly polymers of an α-olefin having 2 to 10 carbon atoms such as polyethylene, polypropylene or ethylene-propylene copolymers, and synthetic resin films the surface of which has been roughed so as to improve the adhesion to other high molecular weight materials and to improve printability as described in Japanese Patent Publication No. 19068/1972 give good results as a support. Generally, the photographic emulsions can be coated on the above supports in an amount of about $5 \times 10^{-5}$ to $10^{-1}$ mole of the silver halide per square meter of the supports.

The support can be a transparent material or an opaque material depending on the purpose of use of the photosensitive materials. In using a transparent support, not only a colorless support but also a colored support which has been colored with dyes or pigments can be used. Such supports have been employed in X-ray films and have been described in *J. SMPTE.* 67, 296 (1958).

Opaque supports include not only intrinsically opaque supports such as paper but also films prepared by adding dyes or pigments such as titanium oxide to transparent films, synthetic resins films the surface of which has been processed by the method described in Japanese Patent Publication No. 19068/1972, and light shielding papers or synthetic resin films containing carbon black or dyes, etc. When the adhesion between the support and the photographic emulsion layer is insufficient, a subbing layer which is adhesive to both can be employed. Further, the surface of the supports can be subjected to a corona discharge, an ultraviolet light irradiation, a flame treatment, etc. for the purpose of further improving the adhesion.

In order to obtain dye images on the color photographic sensitive materials, the photographic materials, after exposure are development processed. The development processing basically comprises a color development step, a bleaching step and a fixing step. Each step can be conducted separately or two or more steps may be carried out simultaneously using a processing solution capable of preforming these steps. For example, a one-bath bleach-fixing solution is such an example. Further, each step can be carried out as 2 or more steps. Furthermore, it is possible to carry out the processing using a combination of color development, first fixing and bleach-fixing. If desired, the development processing can include other steps such as prehardening, neutralization, first development (black-white development), image stabilization and water washing, etc. The processing temperature is selected depending on the kind of photographic sensitive materials and the method of processing. The temperature is sometimes below about 18° C but often above about 18° C. Particularly, a range of about 20° to 60° C and recently about 30° to 60° C is used. The temperature of each step need not necessarily be the same.

The above described developing agent is a compound which has a primary amino group on an aromatic ring and has the ability of developing exposed silver halide or is a precursor which forms such a compound. Preferred examples of such compounds include 4-amino-N,N-diethylaniline, 3-methyl-4-amino-N,N-diethylaniline, 4-amino-N-ethyl-N-β-hydroxyethylaniline, 3-methyl-4-amino-N-β-hydroxyethylaniline, 4-amino-3-methyl-N-ethyl-N-β-methanesulfonamido ethylaniline, 4-amino-N,N-di-methylaniline, 4-amino-3-methoxy-N,N-diethylaniline, 4-amino-3-methyl-N-ethyl-N-β-methoxyethylaniline, 4-amino-3-methoxy-N-ethyl-N-β-methoxyethylaniline, 4-amino-3-β-methanesulfonamidoethyl-N,N-diethylaniline and salts thereof (for example, the sulfates, hydrochlorides, sulfites and p-toluenesulfonates, etc.). In addition, the compounds described in U.S. Pat. Nos. 2,193,015 and 2,592,364, Japanese Patent Application (OPI) No. 64933/1973 and L. F. A. Mason, *Photographic Processing Chemistry,* pages 226 – 229, Focal Press, London (1966) can be used.

Further, the above described compounds can be used together with 3-pyrazolones. If desired, various additives can be added to the color developer.

Examples of suitable additives include alkali agents (for example, alkali metal or ammonium hydroxides, carbonates, or phosphates), pH controlling agents or buffer agents (for example, weak acids such as acetic acid or boric acid, weak bases or the salts thereof), development accelerating agents (for example, pyridinium compounds or cationic compounds described in U.S. Pat. Nos. 2,648,604 and 3,671,247, potassium nitrate or sodium nitrate, polyethylene glycol condensates of the derivatives thereof described in U.S. Pat. Nos. 2,533,990, 2,577,127 and 2,950,970, nonionic compounds such as polythioethers represented by the compounds described in British Pat. Nos. 1,020,033 and 1,020,032, sulfite ester containing polymer compounds represented by the compounds described in U.S. Pat. No. 3,068,097, organic amines such as pyridine or ethanolamine, benzyl alcohol or hydrazines, etc.), antifogging agents (for example, alkali metal bromides or alkali metal iodides, nitrobenzimidazoles described in U.S. Pat. No. 2,496,940, mercaptobenzimidazole, 5-methylbenzotriazole or 1-phenyl-5-mercaptotetrazole, compounds for rapid processing solutions described in U.S. Pat. Nos. 3,342,596, 3,295,976, 3,615,522 and 3,597,199, thiosulfonyl compounds described in British Patent 972,211, phenazine-N-oxides described in Japanese Patent Publication 41675/1971, and antifogging agents described in *Kagakushashin Binran* (*Handbook of Photographic Science*), Vol. 2, pages 29 – 47, stain or sludge inhibiting agents described in U.S. Pat. No. 3,161,513 and 3,161,514 and British Pat. Nos. 1,144,481, 1,030,442 and 1,251,558, interlayer-effect accelerating agents described in U.S. Pat. No. 3,536,487 and preservatives (for example, sulfites, bisulfites, hydroxylamine hydrochloride or alkanolamine sulfite addition products, etc.).

After color development, the photosensitive materials of the present invention can be subjected to bleaching using conventional methods. This processing can be carried out separately or simultaneously with fixing.

It is possible, if desired, to add a fixing agent to this processing solution to form a bleach-fixing bath.

Many compounds can be used as bleaching agents. For example, ferricyanides, dichromates, water soluble cobalt (III) salts, water soluble copper (II) salts, water soluble quinones, nitrosophenols, polyvalent metal compounds such as of iron (III), cobalt (III) or copper (II), etc., and, particularly, complex salts of these polyvalent metal cations and organic acids, for example, metal complex salts of aminopolycarboxylic acids such as ethylenediamine tetraacetic acid, nitrilotriacetic acid, iminodiacetic acid, or N-hydroxyethyl ethylenediamine triacetic acid, etc., malonic acid, tartaric acid, malic acid, diglycolic acid or dithioglycolic acid, etc., and 2,6-dipicoline copper complex salt, etc. peracids, for example, alkyl peracids, persulfates, permanganates, and hydrogen peroxide, etc., hydrochlorites, chlorine, bromine, etc., can be used individually or as a suitable combination thereof.

A bleaching accelerating agent described in U.S. Pat. Nos. 3,042,520 and 3,241,966 and Japanese Patent Publications 8506/1970 and 8836/1970 and other various additives can also be added to this processing solution.

The couplers according to the present invention can be used for every kind of color photographic sensitive materials, such as color negative films, color positive films, color reversal films or color papers, etc. Examples include color direct positive photosensitive materials, photosensitive materials for color diffusion transfer processes, monochromatic photosensitive materials, color X-ray sensitive materials and color microphotosensitive materials, etc.

The couplers according to the present invention can be used for the photosensitive materials having a low silver content wherein the amount of silver halide in the emulsion is from ½ to 1/100 lower than that in the conventional photosensitive materials. In using these photosensitive materials having a low silver halide content, it is possible to obtain sufficient color image density by utilizing a development process which comprises halogenation-bleaching the developed images formed by color development and color development again to increase the amount of dye formed (for example, as described in U.S. Pat. Nos. 2,623,822 and 2,814,565) or a process for increasing an amount of dye formed by employing an image forming process which comprises intensifying using a peroxide or cobalt complex salt (for example, West German Patent Application (OLS) No. 2,357,694, U.S. Pat. Nos. 3,674,490 and 3,761,265, German Patent Application (OLS) Nos. 2,044,833, 2,056,359, 2,056,360 and 2,226,770, and Japanese Patent Application (OPI) Nos. 9728/1973 and 9729/1973, etc.).

An advantage of the couplers of the present invention is that the thickness of the emulsion layers can be made thinner, because the amount of silver halide required for the couplers is stoichiometrically ½ as compared with prior couplers (that is, those wherein a hydrogen atom is present in the coupling position).

Further, in some of the couplers, it is not necessary to use a solvent (oil) having a high boiling point which is usually required for couplers, because of having a sufficient function. Where the image forming layer is thin, the degree of light scattering is low and, consequently, sharper images can be obtained.

Color images obtained by color development of the couplers of the present invention have a spectral absorption chateristic suitable as cyan color images in color photographic sensitive materials for the subtractive color process.

Cyan color images obtained from the couplers of the present invention have good fastness to heat, moisture and light. Although some 2-equivalent couplers have a tendency for residual color to remain, the couplers of the present invention are colorless and hardly any residual color remains.

The present invention will be illustrated in referrence to the following examples. However, the present invention is not to be construed as being limited to these examples.

EXAMPLE 1

A solution prepared by dissolving 10 g of Coupler (4) of the present invention in a mixture of 10 ml of di-n-butyl phthalate and 20 ml of ethyl acetate with heat was added to 110 ml of an aqueous solution containing 10 g of gelatin and 0.5 g of sodium dodecylbenzene sulfonate at 60° C. The mixture was emulsified by vigorously stirring using a homogenizer to prepare an emulsified dispersion of the coupler. The resulting emulsified dispersion was mixed with 300 g of a photographic emulsion containing 0.12 mols of silver bromochloride (containing 80 mol% bromide) and 24 g of gelatin. In addition, 5 ml of a 2 wt% solution of 5-methyl-7-hydroxy-1,3,4,7a-tetrazaindene in methanol, 10 ml of a 2 wt% aqueous solution of potassium polystyrene sulfonate and 10 ml of a 2 wt% aqueous solution of sodium 1-hydroxy-3,5-dichloro-s-triazine were added to the above mixture. After adjusting the final pH to 6.5, the emulsion was applied to a cellulose triacetate film support so as to form a film having a dry film thickness of 4 $\mu$ (Film (1)).

For the pruposes of comparison with the above described coupler, 6.6 g of a coupler which has no substituent in the coupling position thereof; 1-hydroxy-N-[γ-(2,4-di-t-amylphenoxy)propyl]-2-naphthamide, was used instead of the above described Coupler (4) and emulsified in the same manner as described above. Then the emulsion was applied to the film support and dried (Film (A)).

These films were exposed to light through a step wedge and subjected to the following color development processing.

| Color Development Processing: | | |
|---|---|---|
| Color Development | 24° C | 12 minutes |
| Water Wash | " | 30 seconds |
| First Fixing | " | 4 minutes |
| Water Wash | " | 4 minutes |
| Bleaching | " | 8 minutes |
| Water Wash | " | 4 minutes |
| Second Fixing | " | 4 minutes |
| Water Wash | " | 6 minutes |
| Drying | | |

The processing solutions employed had the following compositions.

| Composition of Color Developer: | |
|---|---|
| Sodium Hexametaphosphate | 2 g |
| Sodium Sulfite (anhydrous) | 2 g |
| Benzyl Alcohol | 5 ml |
| Sodium Carbonate (monohydrate) | 27.5 g |
| Potassium Bromide | 0.5 g |
| Hydroxylamine Sulfate | 2.5 g |
| N-Ethyl-N-(β-methanesulfonamidoethyl)-3-methyl-4-aminoaniline Sulfate | 25 g |
| Water to make | 1 liter |
| **Fixing Solution** | |
| Sodium Thiosulfate (hexahydrate) | 80 g |
| Sodium Sulfite (anhydrous) | 5 g |
| Borax | 6 g |
| Glacial Acetic Acid | 4 ml |
| Potassium Alum | 7 g |
| Water to make | 1 liter |
| **Bleaching Solution** | |
| Potassium Ferricyanide | 100 g |
| Potassium Bromide | 5 g |
| Boric Acid | 10 g |
| Borax | 5 g |
| Water to make | 1 liter |

As the result of evaluating the optical density of these film samples using red light after processing, it was found that clear cyan images having the photographic properties shown in Table 2*a* and a main absorption of 695 nm were obtained.

Table 2a

| Film | $D_{max}$ | Relative Sensitivity | Fog | Gradation |
|---|---|---|---|---|
| Film (1) | 2.65 | 125 | 0.05 | 3.0 |
| Film (A) | 2.50 | 100 | 0.06 | 2.8 |

It can be understood from the results in Table 2*a* that the coupler of the present invention provides high sensitivity, high gradation and high maximum color density ($D_{max}$) and low fog.

In order to demonstrate substantial influence of the pKa value on photographic properties, Film (2) was prepared in the same manner as described above except that 8.4 g of Coupler (10) (pKa of parent acid = 2.4) was employed instead of Coupler (4). Similarly, Film (D) was prepared using 7.8 g of Comparison Coupler (D) in place of Coupler (4).

These film samples were exposed to light in the same manner as in Film (1) and Film (A) above and subjected to color development processing, respectively. Then, the evaluation of these film samples was made using red light. The results are shown in Table 1b below.

Table 2b

| Film | $D_{max}$ | Relative Sensitivity | Fog | Gradation |
|---|---|---|---|---|
| Film (2) | 2.05 | 120 | 0.03 | 2.8 |
| Film (D) | 1.60 | 110 | 0.02 | 2.5 |

It can be understood from the results in Table 2b that the coupler which has a pKa outside the range set forth in the present invention provides extremely inferior maximum color density ($D_{max}$) to the coupler of the present invention.

EXAMPLE 2

8.8 g of Coupler (9) of the present invention was used and the coupler was emulsified according to the method of Example 1 and coated on film and dried. (Film (3)).

This film was exposed to light in the same manner as in Example 1 and subjected to color development processing. Thus, clear cyan images having a high color density were obtained.

The fastness of the dyes after being allowed to stand at 80° C for 1 week in the dark and that after being allowed to stand at 60° C under 75% relative humidity for 4 weeks in the dark were examined in the cases of Film (1) and Film (A), obtained in Example 1, and Film (3), obtained in this example. The results were represented as a reduced ratio (%) which is the ratio of the reduced value ($D_o - D$) of the density (D) after evaluation to the initial density ($D_o$).

$$\text{Reduced Ratio (\%)} = \frac{(D_o - D)}{D_o} (\times 100)$$

The results obtained are shown in Table 3.

Table 3

| Film | 80° C, 1 Week | 60° C, 75% RH, 4 Weeks |
|---|---|---|
| | (%) | (%) |
| Film (1) | 6 | 7 |
| Film (3) | 8 | 8 |
| Film (A) | 12 | 14 |

It can be understood form these results that the fastness of dyes to heat and moisture in using the couplers of the present invention is remarkably improved as compared with the using a coupling position unsubstituted coupler.

EXAMPLE 3

9.5 g of Coupler (7) of the present invention was used and emulsified in the same manner as in Example 1 and coated on a film support and dried to produce a film sample.

This film sample was exposed to a light through a step wedge and subjected to the following color development processing.

| Color Development Processing | | |
|---|---|---|
| Color Development | 30° C | 6 minutes |
| Water Wash | " | 2 minutes |
| Bleach-Fixing | " | 1 minute and 30 seconds |
| Stabilizing | " | 2 minutes |
| Drying | | |

The compositions of the processing solutions used were as follows.

| Color Developer | |
|---|---|
| Benzyl Alcohol | 12 ml |
| Diethylene Glycol | 3.5 ml |
| Sodium Hydroxide | 2 g |
| Sodium Sulfite (anhydrous) | 2 g |
| Potassium Bromide | 0.4 g |
| Sodium Chloride | 1 g |
| Borax | 4 g |
| Hydroxylamine Sulfate | 2 g |
| N-Ethyl-N-(β-methylsulfonamidoethyl)-3-methyl-4-aminoaniline Sulfate | 5 g |
| Water to make | 1 liter |
| **Bleach-Fixing Solution** | |
| Iron (III) Ethylenediaminetetraacetate | 40 g |
| Ammonium Thiosulfate (70 wt% aqueous solution) | 150 ml |
| Sodium Sulfite (anhydrous) | 12 g |
| Water to make | 1 liter |
| **Stabilizing Solution** | |
| Sodium Benzoate | 0.5 g |
| Glacial Acetic Acid | 13 ml |
| Citric Acid (dihydrate) | 4.2 g |
| Sodium Citrate (dihydrate) | 3.9 g |
| Water to make | 1 liter |

As the result of the processing, it was clear that Coupler (7) of the present invention was excellent because clear cyan color images having a high maximum color density were obtained by using this coupler. Further, as the result of examination of the fastness of the dyes to light and moisture in the same manner as in Example 2, it was found that the coupler of the present invention had excellent fastness to light and moisture.

EXAMPLE 4

On a polyethylene coated baryta paper was coated 460 g of a blue-sensitive silver bromochloride emulsion containing 6 g of α-pivaloyl-α-(2,4-dioxo-5,5-dimethyloxazolidinyl)-2-chloro-5-[α-(2,4-di-t-amylphenoxy)butyramido]acetanilide as the first layer in a dry film thickness of 3 μ, 20 g of aqueous gelatin solution containing 0.3 g of 2-t-octylhydroquinone as a second layer in a dry dilm thickness of 1.5 μ, 230 g of a green-sensitive silver halide photographic emulsion containing 4 g of 1-(2,4,6-trichlorophenyl)-3-{3-[α-(2,4-di-t-amylphenoxy)butyramido]benzamido}-5-pyrazolone as a third layer in a dry film thickness of 1.7 μ, 50 g of an aqueous gelatin solution containing 0.1 g of 2,5-di-t-octylhydroquinone, 0.5 g of 2-(5-chlorobenzotriazol-2-yl)-4-methyl-6-t-butylphenol and 0.4 g of 2-(benzotriazol-2-yl)-4-t-butylphenol as a fourth layer in a dry film thickness of 2 μ, an emulsion which was prepared by emulsifying 6.5 g of Coupler (6) of the present invention in the same manner as in Example 1 and mixing the emulsion with 360 g of a red-sensitive silver halide photographic emulsion as a fifth layer in a dry film thickness of 2.5 μ, and gelatin as a top layer in a thickness of 1 μ.

This color printing paper was exposed to light through various color negatives and subjected to color development processing in the same manner as in Example 3.

Thus, color photographic images having excellent color reproduction and sharpness which contained cyan color images having an absorption maximum of 665 nm were obtained on this color printing paper.

While the invention has been described in detail and with reference to specific embodiments thereof, it will be apparent to one skilled in the art that various changes and modifications can be made therein without departing from the spirit and scope thereof.

What is claimed is:

1. A photographic material comprising a silver halide photographic emulsion containing at least one of the photographic couplers represented by the formula (I)

$$[A]-NHCOR \quad (I)$$

wherein A represents a cyan color forming coupler residue having a naphthol coupling nucleus or phenol coupling nucleus; the RCONH-group is a substituent in the coupling position of [A], said coupling position being the 4-position of said naphthol or phenol nucleus, and R represents (1) an aliphatic hydrocarbon or alicyclic hydrocarbon group which has at least one electron attractive substituent in the α-position to the carbonyl group in the RCONH- group, or (2) an aryl group, a heterocyclic group, an alkoxycarbonyl group, an aryloxycarbonyl group, a carbamoyl group, an acyl group or an amino group which may be substituted with one or more electron attractive substituents and said R as defined above is a residue derived from a carboxylic acid of the formula RCOOH having a pKa of about 1.3 or less.

2. The photographic material of claim 1 comprising a support having thereon the silver halide photographic emulsion.

3. The photographic material of claim 1 being a multilayer color photographic material comprising a support having thereon at least one silver halide emulsion layer containing at least one coupler of the formula (I).

4. The photographic material of claim 1, wherein R in the formula (I) represents (1) an aliphatic hydrocarbon or alicyclic hydrocarbon group having 1 to 32 carbon atoms which has at least one electron attractive substituent in the α-position to the carbonyl group in the RCONH- group, or (2) an aryl group, a heterocyclic group, an alkoxycarbonyl group, an aryloxycarbonyl group, a carbamoyl group, an acyl group, or an amino group, said electron attractive substituent being a halogen atom, a nitro group, a cyano group, a carbonyl-containing group, a carboxyl group, a sulfonyl-containing group or a sulfo group, and said R as defined above is a residue derived from a carboxylic acid of the formula RCOOH having a pKa of about 1.3 or less.

5. The photographic material of claim 1, wherein said coupler of the formula (I) is represented by the formula $$R_2-[A_2]-NHCOR_4 \quad (III)$$

wherein $[A_2]$ represents a naphthol cyan color forming coupler, $R_2$ is substituted in the 2-position of said naphthol nucleus and represents a hydrogen atom, an alkyl group, or a carbamoyl group represented by the formula (VIII) or (IX)

$$-CO-NH-X \quad (VIII)$$

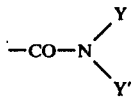

(IX)

wherein X represents a straight or branched chain alkyl group, an alicyclic hydrocarbon group or an aryl group, which alkyl group and aryl group may be substituted with one or more of a halogen atom, a nitro group, a hydroxyl group, a carboxyl group, an amino group, an aryl group, an alkoxycarbonyl group, an acyloxycarbonyl group, an amido group, an imido group, a carbamoyl group, a sulfamoyl group, an alkoxy group, or an aryloxy group; Y and Y' each represents a group described above for X; $R_4$ represents an aliphatic hydrocarbon group substituted with at least one electron attractive substituent in the α position to the carbonyl group in the $R_4$CONH-group, an aryl group or a heterocyclic group; and said R as defined above represents a residue derived from a carboxylic acid of the formula R COOH having a pKa of about 1.3 or less.

6. The photographic material of claim 5, wherein the coupler of the formula (III) is represented by the formula (XI)

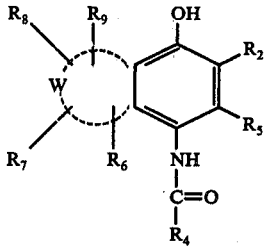

(XI)

wherein $R_2$, and $R_4$ each has the same meaning as defined above, $R_5$, $R_6$, $R_7$, $R_8$ and $R_9$ which may be the same or different, each represents a hydrogen atom, a halogen atom, an alkyl group, an aryl group, an alkoxy group, an alkylthio group, a heterocyclic group, an amino group, a carbamido group, a sulfonamido group, sulfamoyl group or a carbamoyl group; and W represents a group of non-metal atoms necessary to form a naphthol ring together with the phenol ring.

7. The photographic material of claim 1, wherein said coupler is 1-hydroxy-4-trichloroacetamido-N-n-octadecyl-2-naphthamide.

8. The photographic material of claim 1, wherein said coupler is 1-hydroxy-4-(2,2,3,3,4,4,5,5)-octafluorovaleramido-N-[γ -(2,4-di-tert-amylphenoxy)-propyl]-2-naphthamide.

9. The photographic material of claim 1, wherein said coupler is 1-hydroxy-4-pentafluorobenzamido-N-[γ-(2,4-di-tert-amylphenoxy)propyl]-2-naphthamide.

10. The photographic material of claim 1, wherein said coupler is 1-hydroxy-4-heptafluorobutyramido-3'-

[α-(3-tert-butyl-4-hydroxyphenoxy)tetradecanamido]-2-naphthanilide.

11. The photographic material of claim 1, wherein said coupler is 1-hydroxy-4-trichloroacetamido-N-[γ-(2,4-di-tert-amylphenoxy)propyl]-2-naphthamide.

12. The photographic material of claim 1, wherein said coupler is 1-hydroxy-4-dichloroacetamido-N-[γ-)2,4-di-tert-amylphenoxy)propyl]-2-naphthamide.

13. The photographic material of claim 1, wherein said coupler is 1-hydroxy-4-(2-nitrobenzamido)-2-naphthanilide.

14. A method of forming color images comprising development processing an exposed silver halide photographic material of claim 1 with an aromatic primary amine developing agent, to carry out a coupling reaction between said developing agent and the photographic coupler of the formula (I) during silver halide development.

* * * * *